United States Patent [19]

Marsh

[11] 4,090,045

[45] May 16, 1978

[54] KEYBOARD STRIP SWITCH ASSEMBLY HAVING MULTIFURCATED CONDUCTIVE SCREEN CONTACT WITH CONTACT CLEANING WIPING-ACTION

[75] Inventor: Richard E. Marsh, West Chicago, Ill.

[73] Assignee: Marsh Products, Inc., Batavia, Ill.

[21] Appl. No.: 783,684

[22] Filed: Apr. 1, 1977

Related U.S. Application Data

[63] Continuation of Ser. No. 640,748, Dec. 15, 1975, abandoned.

[51] Int. Cl.[2] ..... H01H 13/70; H01H 1/18

[52] U.S. Cl. ..... 200/5 A; 200/86 R; 200/159 B; 200/241; 200/275; 200/308

[58] Field of Search ..... 200/5 R, 5 A, 86 R, 200/275, 159 B, 308, 317, 164 R, 239–242, 310, 314

[56] References Cited

U.S. PATENT DOCUMENTS

| | | | |
|---|---|---|---|
| 3,056,005 | 9/1962 | Larson | 200/86 R |
| 3,165,606 | 1/1965 | Cooper | 200/86 R |
| 3,243,540 | 3/1966 | Miller | 200/86 R |
| 3,283,096 | 11/1966 | Horton | 200/86 R |
| 3,591,749 | 7/1971 | Comstock | 200/308 |
| 3,617,666 | 11/1971 | Braue | 200/86 R |
| 3,627,927 | 12/1971 | Schmitz et al. | 200/159 B X |
| 3,688,066 | 8/1972 | Adelson et al. | 200/159 B |
| 3,743,797 | 7/1973 | Hoffman | 200/159 B X |
| 3,745,287 | 7/1973 | Walker | 200/159 B |
| 3,862,381 | 1/1975 | Glaister et al. | 200/159 B X |
| 3,862,382 | 1/1975 | Glaister et al. | 200/159 B X |

FOREIGN PATENT DOCUMENTS

| | | | |
|---|---|---|---|
| 2,268,342 | 11/1975 | France | 200/5 A |
| 2,335,907 | 1/1975 | Germany | 200/159 B |

*Primary Examiner*—James R. Scott
*Attorney, Agent, or Firm*—Leo J. Aubel

[57] ABSTRACT

A strip switch assembly or switch array formed in a flat configuration with minimal depth and of relatively small size wherein the array is formed of a number of individual switches and the switches are formed of components used in common, and wherein the number of components in the array effectively revolves itself into less than one component per switch.

2 Claims, 8 Drawing Figures

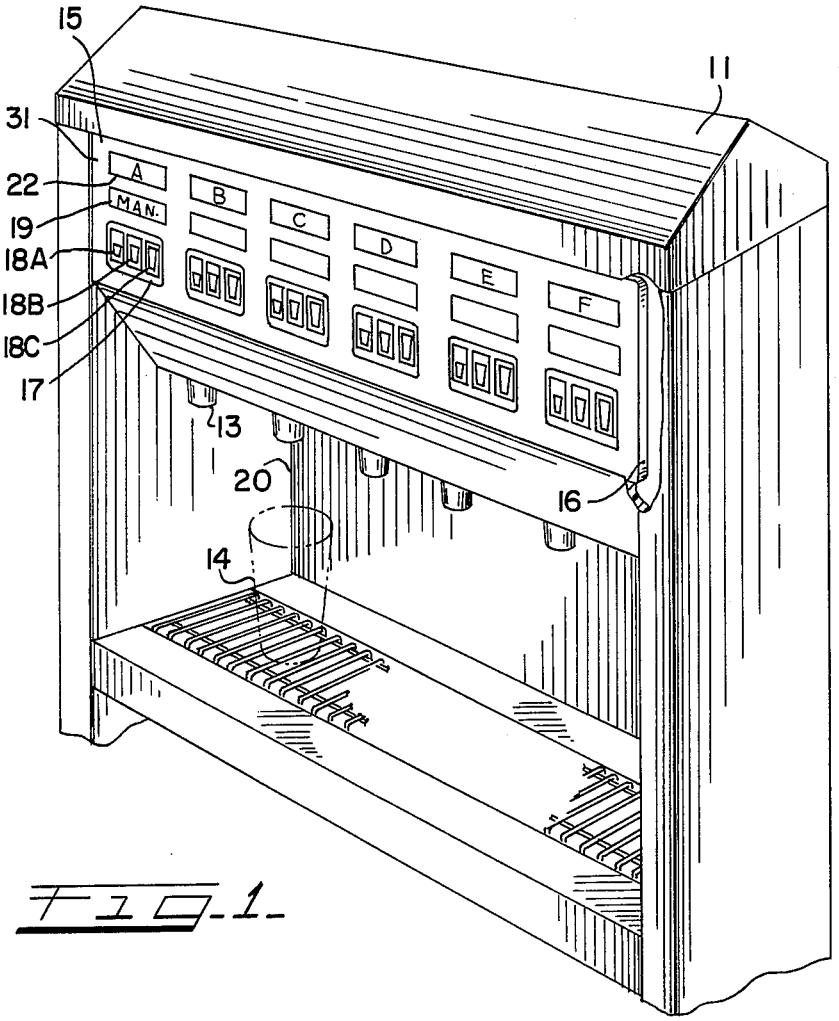
FIG. 1
FIG. 3
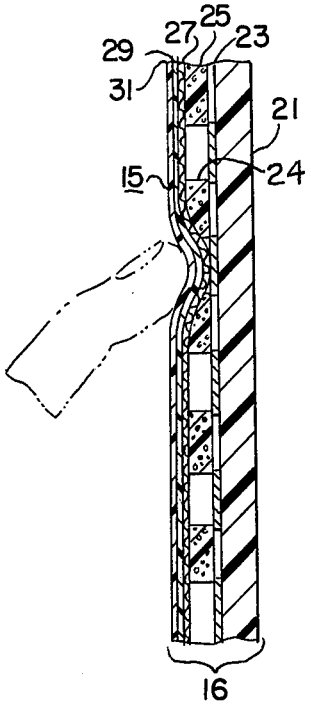
FIG. 2
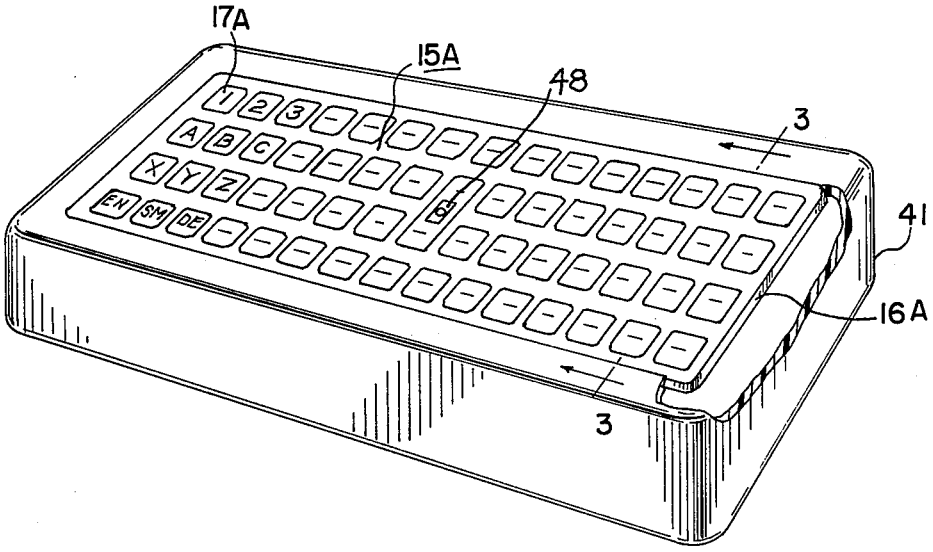

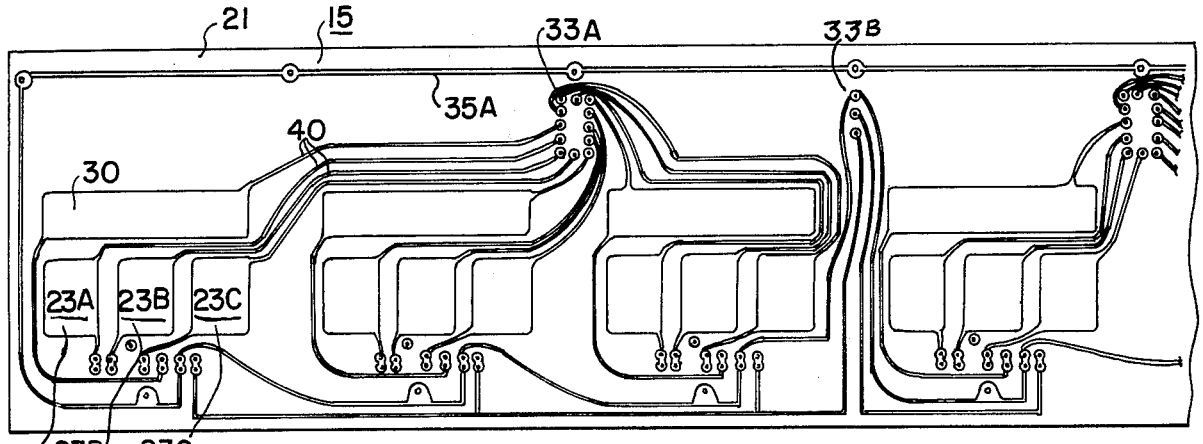
FIG. 4
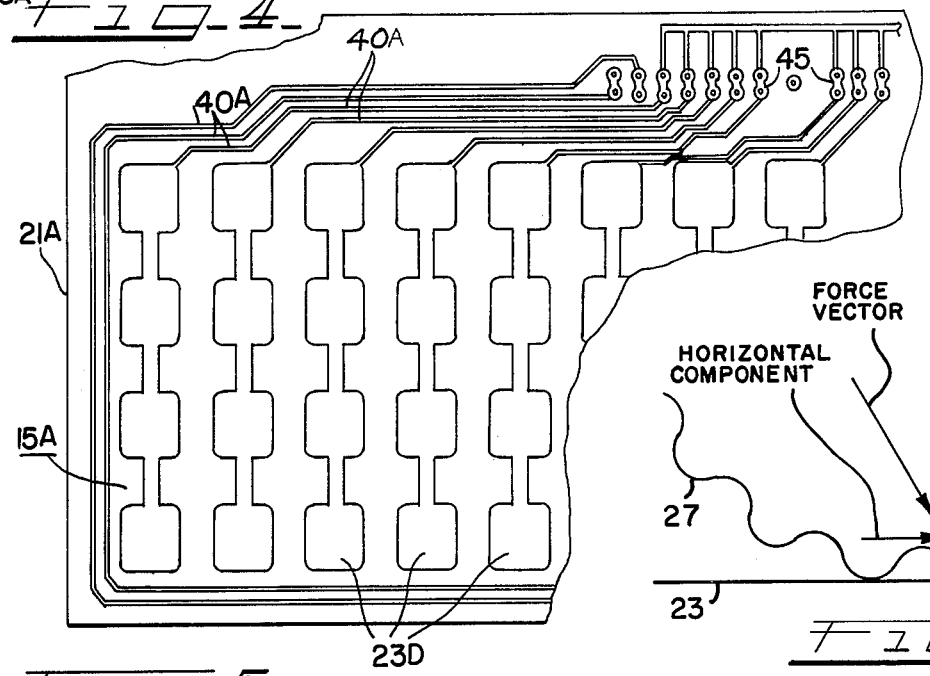
FIG. 5
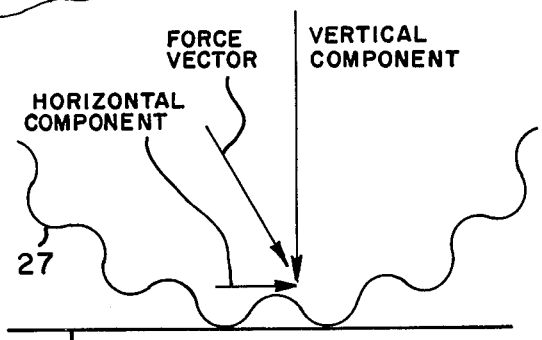
FIG. 3A
FIG. 5A
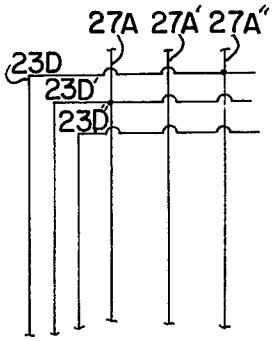
FIG. 6
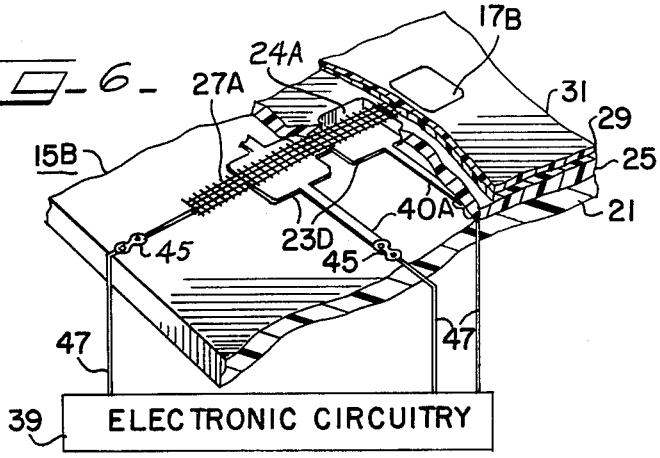

KEYBOARD STRIP SWITCH ASSEMBLY HAVING MULTIFURCATED CONDUCTIVE SCREEN CONTACT WITH CONTACT CLEANING WIPING-ACTION

This is a continuation, of application Ser. No. 640,748, filed Dec. 15, 1975, now abandoned.

BACKGROUND OF THE INVENTION

A demand exists for arrays of actuators, manually operated switches or electrical contacts, for facilitating the manual entry of data and instructions into various types of electronic and electrical equipment. These manually operated arrays of switches may be referred to as key boards or as control panels dependent on the application.

The prior art discloses arrays of switches which comprise individual switches which are mounted in groups to form the desired array. Such prior art arrays require a large number of component parts and have the inherent disadvantages of complexity in assembly, high costs and susceptibility of failure. One example of one such prior art switch utilizes seven component parts; and therefore, for example, a fifty switch array utilizing such prior art switches would contain 350 components parts. Further, the adaptability and versatility of prior art arrays are limited by the relatively larger dimensions of the switches.

In an attempt to improve the switch arrays, certain other prior art arrays have utilized printed circuit boards as a common carrier for the individual switch assemblies and switch components. The use of printed circuit boards tends to reduce the number of components per switch and thus, also tends to reduce the number of components per array. However, the prior art arrays utilizing printed circuit boards still have basically the same disadvantages as the other prior art arrays.

Accordingly, it is a principal object of the present invention to provide an improved array of switches having a minimum number of components, wherein the total number of components in the array effectively resolves itself into less than one component per switch.

It is another object of the invention to provide a switch array assembly which has a minimum depth measured from its front panel, and is of overall relatively small size.

It is another object of the invention to provide a switch array having multifurcated contacts wherein the switches may be readily interwired in any mode desired such as in a single contact arrangement, in a matrix, or in selected combination arrangements.

It is another object of the invention to provide a switch which provides a simple manual assembly and which can be individually sealed, or collectively sealed from the environment; and, to provide an array of switches which can be readily varied as to the number of switches in the array.

SUMMARY OF THE INVENTION

In one embodiment, the inventive strip switch assembly or switch array includes a base on which are formed separate and distinct stationary contact areas, and preferably as printed circuits. A flexible, flat, electrically conductive member, such as a screen material, is positioned in spaced relation to the stationary contacts to provide the movable contacts. A resilient pad having apertures corresponding to the stationary contact area is positioned between the stationary contacts and the material comprising the movable contacts thereby defining a space between the stationary and movable members. A thin film such as of plastic, having information printed thereon at positions corresponding to each selected stationary contact, is positioned over the resilient pad to provide a visual indication to the operator of the significance of each particular entry. To operate or actuate a switch contact, the movable strip member is depressed at a selected area to establish contact with a selected one of the stationary contacts.

Another embodiment of the invention is similar to that described above; however, in this latter embodiment, the printed circuit and movable contact material are arranged in an X-Y or column and row matrix configuration. In this latter configuration, the flexible material is arranged in strips to correspond to respective rows or columns of the stationary contacts. Thus one or more switch contact areas may be actuated to provide a selected entry to the associated electronic circuitry.

The features and advantages of the present invention will become apparent from the following more particular description of the preferred embodiments of the invention, as illustrated in the accompanying drawings wherein:

DESCRIPTION OF THE DRAWINGS

FIG. 1 is an isometric view of one embodiment of the inventive switch array mounted on a liquid or drink dispensing unit or tower;

FIG. 2 is an isometric view of a data input station showing another embodiment of the inventive switch array arranged in a matrix configuration wherein one or more of the contacts may be actuated to provide selected entry into an associated electronic circuitry;

FIG. 3 is a cross-sectional view taken along the lines 3—3 of FIG. 2 showing the laminated or overlay type construction of the inventive switch array assembly;

FIG. 3A is a relatively enlarged sketch of that portion of FIG. 3 indicated as being depressed by an operator's finger;

FIG. 4 is a top or plan view of a base of one embodiment of the inventive switch array showing distinct printed circuit electrical contact areas and leads such as utilized in the embodiment of FIG. 1;

FIG. 5 is a top or plan view of a base of another embodiment of the inventive switch array showing printed circuit electric contact areas and leads such as utilized in the embodiment of FIG. 2;

FIG. 5A is a schematic diagram indicating a manner in which the circuit of FIGS. 2 and 5 are electrically connected;

FIG. 6 is a cut away of an isometric view of the structure such as shown in FIGS. 1, 2 and 3 to show the laminated or overlay type relation of the components of the inventive assembly.

DESCRIPTION OF THE INVENTION

It should be understood at the outset that electrically, the inventive strip switch assembly or switch array simply provides a number of generally open contacts which are manually and selectively actuable to close the electrical circuit path to the associated electronic equipment. The invention is directed to such a switch array and while the switch array is shown in use with particular equipment, its use is not limited thereto.

Also, the basic mechanical constructions of the embodiments of the switch array 15 and 15A shown and described herein are substantially the same. There is a variation in the way the switches may be electrically connected to the associated electronic curcuitry, that is, the switches may be connected either to provide individual switching action or to provide a matrix type switching, as is well known.

A liquid or drink dispensing tower 11 utilizing the inventive strip switch assembly or switch array 15 is shown in FIG. 1; the similar array 15A utilized for another application is shown in FIG. 2. The relatively thin dimension 16 of arrays 15 and 15A is an important structural advantage. The drink tower of FIG. 1 may be constructed in any suitable known manner and includes the usual tubing or piping for providing a liquid indicated as 20 through the usual spouts 13 to fill a container, such as a cup, 14, placed beneath a selected spout. The switch array 15 provides the means for switching in, or initiating the flow of the liquid 20 to the cups 14. Various electrical and electronic circuitry of any suitable known design, indicated as 39 in FIG. 6, which circuitry does not, per se, form a part of this invention, is included in the drink tower 11 to provide the control of the flow of the liquid.

The switch array 15 is actuated to initiate the flow of the liquid 20. Each of the areas of panels generally referenced as 31 are also individually labeled A, B, C, D, E, and F (because of space limitations) in the drawing of FIG. 1. In the commercial model, the panels 31 are actually labeled cola, orange, lemonade, etc. designate the drink to be received from the associated spout. The areas or panels, generally referenced as 19 and also labeled Man. provide manual control. That is, when a selected panel 19 is pressed, it will provide the electrical contact on the associated electronic circuitry 39 (see FIG. 6) to initiate flow of a particular drink and the drink will continue to pour until such time as the pressure is released from that particular panel 19.

Beneath each manual control panel is still another panel generally labeled 17, including three subpanels 18A, 18B and 18C showing a figure of small, medium and large cups 14. Subpanels 18A, 18B and 18C automatically control the pouring of the liquid through the respective spout. For example, when pressure is applied to a panel 18A, it will actuate the associated electronic circuitry 39 to pour liquid for a preset time period to fill a small container or cup 14. Similarly, if panel 18B is pressed, the electronic circuitry 39 will cause liquid to flow for a longer period of time to fill an intermediate size cup. Likewise, when subpanel 18C is depressed, it will cause the electronic circuitry to permit liquid to flow for a longer period of time to fill the larger size cup. Each of the panels 18A, 18B and 18C and 18 may be actuated by finger pressure, as indicated in FIG. 3, to establish electrical contact closure as will be described hereinbelow.

Another example of the use of the inventive assembly is shown in FIG. 2 wherein the switch assembly or array 15A is arranged in the form of a matrix. In FIG. 2, the switch areas have a designation thereon to indicate a type of food desired, for example, HMB to indicate a hamburger, CHB to indicate a cheese-burger, FF to indicate french fries, etc. Because of space limitations in the drawings, the switch areas are labeled 1, 2, 3; A. B. C; X, Y, Z, etc. in FIG. 2. In the center of the array a suitable light emitting diode or small light 48 may be included to indicate the operating condition of the array 15A.

One group of switch areas shown in the matrix, can designate the item desired, another group of switch areas can designate the number of a particular item desired, a third group of switches can designate condiments desired on each item and still another group of switches can indicate the processing of the order; for example, cancellation, hold, payment, or modification, etc.

Consider now the structure of the inventive switch assembly or switch array 15. As shown in FIGS. 3 and 6, the switch array generally labeled 15, comprises a base 21 which may be a plate of relatively rigid plexiglass, plastic, or other non-conductive material. As shown in FIGS. 4 and 5, discrete, stationary, electrical contact areas, generally labeled 23, comprising part of a printed circuit, are formed on the base 21. The electrical contact areas, individually labeled 23A, 23B, 23C in FIG. 4 and 23D in FIGS. 5 and 6, are, as is well known, connected through printed circuit leads 35A and 40 in FIG. 4 and 40A in both FIGS. 5 and 6 to suitable electrical terminals indicated as 33A in FIG. 4 and 45 in FIGS. 5 and 6. Suitable electrical wiring 47 as depicted in FIG. 6 connects the terminals 45 in FIGS. 5 and 6 to associated electronic circuitry 39. Similarly, suitable leads, not shown, connect terminals 33A and 33B to the associated electrical circuitry. The stationary contacts, generally labeled 23, may be of any suitable material depositable on base 21 and may be shaped in rectangular or oval shape and are of a size to conform to an operator's finger, see FIG. 3.

Refer to the cross-sectional view of FIGS. 3 and 6 which clearly show the overlay or laminated type construction of switch array 15. A resilient pad such as of polyurethane foam, formed to have holes or apertures 24 and 24A to accommodate the respective stationary contacts 23 and 23D is placed over or mounted on base 21. The pad 25 may be of a selected thickness and density to have a suitable resiliency to provide a tactile signal to the operator to indicate the actuation of a switch contact.

A screen material, generally labeled 27, which provides the movable contacts of each switch, may be a single sheet 27 or may be strips of material 27A extending over the apertured foam pad 25. The screen material may be bronze, or any other good electrical conductor which is resistant to corrosion. The movable contact is connected to its respective electrical terminal such as lead 35A in FIG. 4, which, in turn, is connected to the associated electronic circuitry through terminal 33B.

As mentioned, the screen material 27 is positioned over the resilient pad 25 to have the holes thereof in registry with its respective stationary contact 23B, thereby forming an air space therebetween. As shown in FIG. 3, the material can thus be actuated downwardly through the hole 24 in the pad 25 to make contact with a corresponding stationary contact 23.

The resilience of the pad 25 causes the conductive material 27 to return to its original position when the operator removes the finger pressure.

Also, as can be appreciated from FIGS. 5 and 5A, a selected strip 27A of screen material can be actuated to make an electrical connection to a selected contact area 23D.

With the screen material formed as strips 27A as indicated in FIG. 6, for use in the structure of FIGS. 2 and 5, an electrical configuration results such as indicated schematically in FIG. 5A.

As indicated in FIG. 5A, a strip material may comprise each of lines 27A, 27A' and 27A". As noted above, lines 27A, 27A' and 27A" are flexible and movable to make selective contact with respective stationary contacts 23D, 23D' and 23D". For example, by moving lines 27A and 27A" to close a contact at the point or area where these lines respectively cross the stationary contacts 23D and 23D' in FIG. 5A, a double entry can be provided to the associated electrical or electronic circuitry 39. Accordingly, an order of a particular item and the quantity of that item desired can be entered concurrently.

Thus, the switch contact areas can be connected to the associated electronic circuit in any desired pattern or program to affect any particular type of entry desired. Note also that the strip 27A can be made wide enough to overlay more than one row or column of stationary contact pads or wide enough to overlay the entire face of the switch array.

A clear plastic film 29 such as Mylar® is placed to overlay the conductive sheet or strip material 17.

A second or top film 31 including suitable printing on its surface, preferable its surface facing the film 29 is placed over the assembly. Wear on the printing on film 31 by the operator's finger is thus prevented. The printing on film 31 such as the cup shown in panels 18A, 18B and 18C of FIG. 1 and the numbers and letters shown in FIG. 2 designate the function of the particular switch area. Film 29 also provides the function of preventing wear on the printing on the film 31 by screen material 27.

It should be clearly understood that the switch contact area can be connected to the associated electronic circuitry in any desired pattern or program to effect any particular type of entry.

The selection of a screen material for the strips 27 provides various advantages including the feature that the screen material provides a good multifurcated contact surface with high pressure over a small area. In addition, the screen material functions to maintain the contact area clean, since, upon actuation, it affects rubbing or wiping action against the stationary contacts.

Note in FIGS. 3 and 6, the flexible screen material 27A (and 27) effects such multifurcated contact by providing multiple ridges like teeth on a comb, which when actuated, are caused to bear against the flat planar conductive surface 23D (and 23) provide multiple, high pressure electrical contacts. The foregoing structure reduces the adverse effect of contact bounce, i.e., if one ridge or tooth fails to make good electrical contact, the probability is high that others of the adjacent ridges or teeth will make good electrical contact thus providing a good switching action. Further, because each contact area or ridge contact point is small, the pressure against that small area is much higher, thus tending to provide good electrical connection.

In operation, when the pressure of the operator's finger is effective against the flexible screen material 27A (and 27) there is a moment or component of force which is horizontal to the flat planar surface 23D (and 23). Accordingly, this tends to brush the flexible screen material 27A (and 27) (which as stated above and shown in FIG. 3 comprises multiple ridges) in a horizontal direction on the flat planar surface 23D (and 23) to thereby provide a wiping and cleaning action.

To further explain the foregoing, note FIG. 3A which is an enlarged sketch of that portion of FIG. 3 shown as depressed by an operator's finger. As will be readily appreciated, actuation of the flexible screen 27 toward the associated stationary contact pad 23 normally results in a force vector having a vertical component and a horizontal component. The horizontal component causes the screen 27 to move in a horizontal direction over the surface of stationary contact pad 23. Note further that the screen 27 comprises a strip or mesh, see FIG. 6, and the foregoing action occurs over that entire area of the pad 23, which is engaged by multiple contact points of the screen 27.

While the invention has been particularly shown and described with reference to preferred embodiments thereof, it will be clearly understood by those skilled in the art that various changes in form and details may be changed therein without departing from the spirit and scope of the invention.

I claim:

1. An electrical switch array adapted to be actuable such as by finger pressure comprising a plurality of individual electrical switches for effecting selected electrical connections to an associated electrical or electronic curcuitry comprising, in combination, a base of non-conductive material, conductive material formed as a planar surface on said base to provide discrete stationary contacts, flexible conductive screen material means positioned adjacent said stationary contacts, resilient means having apertures corresponding to the stationary contacts positioned intermediate said screen material and said formed material to provide a spacing therebetween, a flexible film positioned over said screen material and having indicia thereon corresponding to respective contact areas, areas of said film and said screen material being selectively actuable from an initial position against said conductive material for providing a multifurcated electrical contact with high pressure over a small area with at least one selected stationary contact, said flexible screen material when actuated by finger pressure also providing a horizontal component of movement on said stationary contact to effect a wiping and cleaning action thereto whereby good electrical contact characteristics are obtained between said flexible screen material and said resilient means tending to restore the moved area of said film and said flexible screen material to their initial position.

2. A switch array as in claim 1 wherein the film has indicia on its side facing said screen material to prevent wear of the indicia by the user's finger, and said array further includes a second plastic film positioned intermediate said indicia carrying film and said screen material to prevent wear of said indicia by said screen material.

* * * * *